United States Patent [19]

Eliades

[11] Patent Number: 4,597,880

[45] Date of Patent: Jul. 1, 1986

[54] ONE-STEP PROCESS FOR PREPARATION OF OVERBASED CALCIUM SULFONATE GREASES AND THICKENED COMPOSITIONS

[75] Inventor: Theo I. Eliades, West Hill, Canada

[73] Assignee: Witco Corporation, New York, N.Y.

[21] Appl. No.: 738,242

[22] Filed: May 28, 1985

Related U.S. Application Data

[63] Continuation-in-part of Ser. No. 531,219, Sep. 9, 1983, abandoned.

[51] Int. Cl.[4] ..... C10M 105/22

[52] U.S. Cl. ..... 252/33.4; 252/18

[58] Field of Search ..... 252/18, 33.4

[56] References Cited

U.S. PATENT DOCUMENTS

| | | | |
|---|---|---|---|
| 3,057,896 | 10/1962 | Schlicht et al. | 252/18 |
| 3,155,617 | 11/1964 | Voorhees | 252/18 |
| 3,242,079 | 3/1966 | McMillen | 252/18 |
| 3,384,587 | 5/1968 | Halst et al. | 252/18 |
| 3,429,811 | 2/1969 | Robbins et al. | 252/18 |
| 3,537,996 | 11/1970 | Holst et al. | 252/18 |
| 3,609,076 | 9/1971 | Sabol et al. | 252/18 |
| 3,746,643 | 7/1973 | Rogers | 252/18 |
| 3,816,310 | 6/1974 | Hunt | 252/33.4 |
| 4,086,170 | 4/1978 | De Clippeleir et al. | 252/18 |

FOREIGN PATENT DOCUMENTS

| | | |
|---|---|---|
| 1187822 | 4/1970 | United Kingdom . |
| 1481553 | 8/1977 | United Kingdom . |
| 1594699 | 8/1978 | United Kingdom . |

*Primary Examiner*—William R. Dixon, Jr.
*Assistant Examiner*—Margaret B. Medley
*Attorney, Agent, or Firm*—Sidney Wallenstein; Harry V. Strampel

[57] ABSTRACT

Improved 1-step process for the preparation of thixotropic overbased calcium sulfonate complex greases or thickened compositions containing calcium sulfonate as a dispersing agent and containing calcium carbonate in the form of calcite crystals in extremely finely divided form colloidally dispersed in said greases or thickened compositions.

14 Claims, No Drawings

ONE-STEP PROCESS FOR PREPARATION OF OVERBASED CALCIUM SULFONATE GREASES AND THICKENED COMPOSITIONS

CROSS-REFERENCE TO RELATED APPLICATION

This application is a continuation-in-part of U.S. patent application Ser. No. 531,219, filed Sept. 9, 1983, now abandoned.

BACKGROUND OF THE INVENTION

1. Field of the Invention

My present invention is directed to an improved 1-step process for the preparation of overbased calcium sulfonate greases and thickened compositions. The greases and thickened compositions of the present invention are of the heretofore known thixotropic type which comprise, advantageously, a volatile and/or nonvolatile liquid carrier or solvent, such as, for example, Varsol or mineral spirits, or a mineral oil or equivalent oil medium in their production, and oil-soluble calcium sulfonates derived from oil-soluble higher molecular weight sulfonic acids, which greases and thickened compositions also contain calcium carbonate as calcite in colloidal or extremely finely divided form. In accordance with my invention, while such types of greases and thickened compositions have heretofore been prepared by what is known to the art as the 1-step process, such 1-step processes, as heretofore known and practiced, have had various deficiencies which are overcome by my present invention.

2. Background of the Invention and Brief Description of the Prior Art

Thixotropic greases or thickened overbased calcium sulfonate compositions having corrosion-inhibiting properties, and having utility for a variety of uses such as, for instance, in automobile and truck body undercoatings, and for various other purposes, are known to the art and are disclosed in various publications and patents, illustrative of which are U.S. Pat. Nos. 3,242,079; 3,372,115; 3,376,222; 3,377,283; 3,523,898; 3,661,622; 3,671,012; 3,746,643; 3,730,895; 3,816,310, and 3,492,231; and Canadian Pat. No. 949,055. Such greases or thickened compositions have gone into quite widespread use either as such, or admixed with other ingredients to produce compositions for use in a variety of environments, and generally speaking, they are characterized by reasonably good E. P. and antiwear properties, high dropping points, reasonably good resistance to mechanical breakdown, salt spray and water-corrosion resistance, thermal stability at high temperatures, and other desirable properties, as described in the aforesaid patents. Such heretofore known greases or thickened compositions are conventionally prepared by what is known as a 2-step process, as more particularly shown in the aforesaid U.S. Pat. Nos. 3,242,079; 3,372,115; and 3,492,231. They have also been prepared by what is known as a 1-step process, as noted above, and as is shown, for instance, in the aforementioned U.S. Pat. Nos. 3,671,012; 3,746,643; and 3,816,310; and Canadian Pat. No. 949,055, which also disclose heretofore known 2-step processes.

In the 2-step process, as shown particularly in U.S. Pat. Nos. 3,242,079; 3,372,115; and 3,492,231, as referred to above, there is initially prepared, by way of illustration, a Newtonian solution by admixing a normally liquid oil, commonly a mineral oil or a mixture comprising a mineral oil and a non-mineral oil volatile organic solvent, usually a hydrocarbon solvent such as hexane, with a normally liquid sulfonic acid comprising or containing an aliphatic straight or branched chain having at least 12 carbon atoms and preferably having a molecular weight in the range of about 370 to about 700, to which are added calcium oxide and/or calcium hydroxide and with a so-called promoter which serves to produce an overbased calcium sulfonate which commonly may have a metal ratio of at least 4.5, usually substantially higher, and the resulting mixture is heated, under conditions of agitation, and then carbonated. This results in a Newtonian solution containing the overbased calcium sulfonate dissolved or colloidally dispersed in the mineral oil or the like, which solution is then filtered to form a clear solution. The resulting clear Newtonian solution, produced in this first step, is then subjected to treatment by a second step which involves generally vigorous admixing, and usually heating, said first-step produced solution with a so-called converting agent which may, for instance, be water, or water-soluble alcohols or glycol ethers such as methylcellosolve (mono-methyl ether of ethylene glycol), or mixtures of water and such alcohols; or water-soluble acids, such as acetic acid or propionic acid, which second step results in converting the Newtonian solution to a non-Newtonian disperse system in the form of a grease or a thickened composition.

The 1-step process of forming the greases or thickened compositions differs from the 2-step process in that, in the 1-step process, generally speaking, essentially all of the ingredients are mixed together and then carbonated, and there is no separately formed, or separately formed and recovered, Newtonian solution of an overbased calcium sulfonate dissolved or colloidally dispersed in mineral oil or other suitable liquid medium or carrier. From an economic standpoint, the 1-step process has a definite advantage over the 2-step process, but the 1-step process has not gone into commercial use to nearly the extent that has been the case with the 2-step process because the 1-step process, as heretofore known and as heretofore commercially practiced or sought to be practiced, has been characterized by numbers of significant disadvantages.

U.S. Pat. No. 3,746,643 discloses a 1-step process of preparing thixotropic overbased calcium sulfonate greases and rust-inhibiting compositions wherein small amounts of water and an alcohol are incorporated into a mixture of a nonvolatile diluent oil, a calcium carbonate complex, and an oil-soluble calcium sulfonate complex dispersing agent. In said mixture, the calcium sulfonate dispersing agent is stated to range from about 2 to about 65 wt. %; the nonvolatile diluent oil is stated to range from about 5 to 80 wt. %; the calcium carbonate complex is stated to range from about 1 to about 25 wt. %; and the water and alcohol are stated to range from about 1 to about 6 wt. %, and from about 1 to about 40 wt. %, respectively. In addition, the mixture of said ingredients is stated to include, optionally, up to 60 wt. % of a volatile processing solvent. The resulting mixture of ingredients is then stated to be heated under controlled conditions to convert the mixture to a grease or rust-inhibiting composition (when cut back with a light hydrocarbon solvent). The patent points out that, to obtain the desired products, the mixture must be heated to a temperature exceeding 50° C. (122° F.), and that it is necessary in traversing the temperature zone from about 50° C. (122° F.) to about 100° C. (212° F.) that the rate of temperature increase not exceed a certain maximum limit where the amount of water present in the mixture is less than 2.5 moles of water per mole of calcium metal present as the carbonate complex.

U.S. Pat. No. 3,671,012 discloses a 1-step process of preparing thixotropic overbased calcium sulfonate greases and grease-like compositions. This is disclosed more particularly in Column 6, Lines 40 to the bottom of the page, extending through Columns 7 and 8 and through Line 25 in Column 9. The procedure described in U.S. Pat. No. 3,671,012 is generally similar to that shown in U.S. Pat. No. 3,746,643 except that the disclosure in U.S. Pat. No. 3,671,012 is in greater detail than is described in U.S. Pat. No. 3,746,643.

U.S. Pat. No. 3,816,310 is generally similar in its disclosure of known 1-step processes to the 1-step process disclosed in the above referred to U.S. Pat. Nos. 3,746,643 and 3,671,012. Taking as illustrative the 1-step process as described in U.S. Pat. No. 3,816,310, as there described in a typical or illustrative embodiment, an admixture is formed consisting essentially of an oil-soluble sulfonic acid or an oil-soluble calcium sulfonate as a dispersing agent, e.g. linear or branched chain "NAB" Bottoms or a $C_{15}$–$C_{18}$ linear alkylbenzene sulfonic acid; liquid medium or carrier material, for instance, a mineral oil; a $C_1$–$C_3$ alkanol, for instance, methyl alcohol; calcium oxide and/or calcium hydroxide; and water; then carbonating the resulting admixture with carbon dioxide while maintaining the temperature below about 165° F. to the extent that at least 1.5 moles of the carbon dioxide per mole of the calcium as calcium carbonate are present in the mixture; and then heating the carbonated admixture to a temperature above 212° F., said heating step being characterized in that the time required to heat to 212° F. is from about 0.5 to about 8 hours, the process being characterized further in that alternatively, the water utilized initially may be added after the carbonation step or just prior to the heating step after the carrying out of the carbonation step. Numbers of nonvolatile liquid media or carrying materials are disclosed, mineral oils generally being preferred where greases are preferred. U.S. Pat. No. 3,816,310 also teaches that a light or relatively volatile hydrocarbon solvent, such as, by way of example, n-decane, benzene, toluene, Stoddard solvent or n-hexane, though not a critical ingredient, may be incorporated into the composition constituting the aforementioned ingredients, and, when included, it is preferable that it be employed in proportions, in terms of wt. %, from about 20 to 80% of the total of the calcium sulfonate and nonvolatile carrier present in the composition to be processed. In those instances in which the final composition produced by the process is to be used as a grease, a high percentage of the mixture of nonvolatile carrier and volatile hydrocarbon solvent should be volatile hydrocarbon solvent; whereas, if the final product produced by the process is to be used as a rust or corrosion protective coating or film, the nonvolatile carrier may be used alone as the carrier or in admixture with relatively smaller amounts of volatile carrier. The patent also specifically states that, when the final product produced by the process of said patent is to be used as a grease, the consistency or thickness of the grease is controlled by using, as the carrier, a relatively nonvolatile mineral oil typically having the general properties of a Bright Stock cut produced in petroleum refining.

U.S. Pat. No. 4,129,589, of which I am one of the joint inventors, discloses a process for preparing overbased oil-soluble magnesium sulfonates having a metal ratio of approximately 10 to approximately 40 by a 1-step process in which oil-soluble magnesium sulfonates dissolved or dispersed in an inert carrier solvent or diluent, such as mineral oils or volatile hydrocarbon solvents such as naphtha, are admixed with a promoter system comprising, for example, acetic acid in admixture with an alcohol such as methanol or an alkoxyalkanol such as methoxy ethanol, and with water; a light magnesium oxide; heating said mixture to from about 50° F. up to the reflux temperature of said mixture; and then carbonating said mixture, after which volatile components may be stripped from the reaction mixture. The resulting overbased, oil-soluble magnesium sulfonates are stated to be useful as additives to lubricants, greases, fuels and the like where they function as detergents and acid neutralizers whereby to reduce wear and corrosion in engines and extending engine life. This patent is irrelevant to my invention because it deals solely with the production of overbased oil-soluble magnesium sulfonates which are Newtonian liquids, which are not thixotropic, and has nothing to do with and contains no suggestion or concept whatever of the preparation of thixotropic overbased calcium sulfonate complexes. The compositions of said patent are worthless and inoperative for the purposes of the thixotropic overbased calcium sulfonate produced in accordance with the 1-step process of my present invention.

One of the main problems with the prior known and practiced 1-step processes for the preparation of thixotropic overbased calcium sulfonate complex greases or thickened products was that of the unpredictability as to whether the greases or thickened products obtained would or would not be at least reasonably satisfactory for commercial usage. Reasonably satisfactory and commercially usable greases and thickened compositions were obtainable, in many instances, in less than 50% of the cases where certain then-known 1-step processes were carried out to produce the desired greases or thickened compositions. Efforts to ascertain why certain batches of greases or thickened compositions were suitable whereas others were not suitable did not lead to any conclusions despite the fact that considerable studies and experimental work were expended in such efforts.

THE PRESENT INVENTION

My present invention has resulted in effectively improving prior defects in known practices in producing overbased calcium sulfonate greases by the use of a novel 1-step process. It has been discovered that, in the carrying out of the improved 1-step process of my present invention, by providing an admixture containing the aforementioned volatile carriers, for instance, Varsol, mineral spirits, or n-hexane, or an admixture thereof with varying amounts of a nonvolatile carrier, particularly a mineral oil of the same kinds as have heretofore been disclosed and used in the preparation of greases or thickened compositions of the type to which my present invention relates; or an oil, particularly a mineral oil without any mixture therewith of a volatile carrier; an oil-soluble sulfonic acid or mixture of oil-soluble sulfonic acids, as a dispersing agent, as have heretofore been known and used; calcium oxide and/or calcium hydroxide, all as heretofore known and used; but including in the admixture of ingredients minor proportions of (a) water-soluble carboxylic acids such as, for example, acetic acid; (b) aliphatic alcohols or alkoxyalkanols, such as methyl alcohol or methylcellosolve; and (c) water; prior to carrying out the carbonation step; and by carrying out the carbonation step under conditions not requiring the rigid controls specified, for instance, in said U.S. Pat. No. 3,816,310, and the other 1-step disclosed processes in said other patents, improvements result which make the 1-step process very considerably more practicable and very largely more consistent and reliable in producing commercially satisfactory batches of the overbased calcium sulfonate greases and thickened compositions of the general type which are obtained by the 1-step process that has been the situation under previously known and practiced 1-step processes.

More specifically, in the practice of my present invention, the mixture of ingredients which is to be subjected to the carbonation step utilizes (a) a water-soluble or water-miscible aliphatic carboxylic acid containing up to 4 carbon atoms, or an aromatic carboxylic acid, such as acetic acid, formic acid, propionic acid, butyric acid or benzoic acid, especially acetic acid; (b) a water-soluble or water-miscible alcohol, preferably containing from 1 to 4 carbon atoms, or an alkoxyalkanol, for instance, a water-soluble mono-alkyl ether of a water-soluble glycol, such as methylcellosolve or ethylcellosolve (mono-methyl or mono-ethyl ether of ethylene glycol, particularly methylcellosolve; and (c) water. This combination of ingredients may be premixed and added as such to the other ingredients, or, alternatively, the (a), (b) and (c) ingredients can be added separately or in any mixture of two of them to the other ingredients. By so proceeding when, as indicated above, the overall mixture of the ingredients includes the (a), (b) and (c) ingredients, prior to carrying out the carbonation step, the desired formation of the colloidal calcium carbonate in the form of calcite crystals and the desired viscosity change to a grease or a thickened composition occurs at the end of the carbonation step or cycle. The volatile solvent may or may not be driven off by distillation or may be driven off in part. The result of the practice of such 1-step process is to produce a non-Newtonian colloidal disperse system, in the form of a grease or thickened composition, containing calcium sulfonate and also containing colloidally dispersed or extremely finely divided calcium carbonate in the form of crystals of calcite, sometimes admixed with minor proportions of calcium carbonate in the form of vaterite.

The ratios of the (a), (b) and (c) ingredients, as specifically and advantageously exemplified by acetic acid, methyl alcohol or methylcellosolve, and water, are variable within reasonable limits but, in general, the amount of the acetic acid (measured as glacial acetic acid) will be substantially less than that of the methyl alcohol or methylcellosolve; and the amount of water will be in the range of about that of the alcohol or methylcellosolve or somewhat less or somewhat more than that of the alcohol or methylcellosolve.

With respect to the matter of the proportions of such ingredients as the carriers, whether volatile or nonvolatile, or mixtures thereof; the calcium oxide and/or calcium hydroxide; the sulfonic acids, the alcohols or glycol ethers or alkoxyalkanols; and the water, no novelty is claimed in such proportions since such proportions are variable and are generally disclosed and taught by prior known 1-step processes. As to the use of the water-soluble acids, such as and particularly acetic acid, no prior art of which I am aware has utilized such acids nor, particularly, acetic acid in a 1-step process of producing thixotropic overbased calcium sulfonate complex greases or thickened compositions; and the same is true as to the use of acids, such as acetic acid, and alcohols such as methanol or glycol ethers such as methylcellosolve or other alkoxyalkanols; conjointly with water in a 1-step process of the type to which my present invention relates, which involves the best and most important embodiments of my present 1-step process invention. The amount of such acids as acetic acid, and the amount of such alcohols as methanol or methylcellosolve, constitute distinctly minor wt. proportions of the ingredients mixture which is prepared for reaction and carbonation, as can be seen from the working EXAMPLES set forth below in the present specification. The acid, such as acetic acid, will usually be somewhat below 0.5 wt. % of the total ingredient mixture (prior to the carbonation step), and, in general, may range from about 0.2 to about 2 wt. % of said ingredient mixture. The alcohol or methylcellosolve or other alkoxyalkanols employed is variable but will commonly be used in the range optimally of about 4 to about 6 wt. %, more or less, based on said ingredient mixture. The water will, as indicated above, commonly be used in ranges generally of those of the alcohol.

According to the 1-step process disclosed in the aforementioned U.S. Pat. No. 3,816,310, at least 1.5 moles of carbon dioxide per mole of calcium should be present in the mixture of ingredients. This is brought out in the specification (e.g., Column 2, Step B). In the 1-step process of the present invention, effective carbonation for the purposes of my invention is sufficiently complete using in the range of only about 0.78 to 0.9 moles per mole of calcium.

In U.S. Pat. No. 3,816,310, the $C_1$–$C_3$ alcohols are used in proportions in the range of 10 to 40 wt. % levels, with 20 to 30% being preferred and with 30% being most preferred. In accordance with my present invention, the said alcohols, where used, but in conjunction or in admixture with a carboxylic acid such as acetic acid, and water, can be used in proportions as low as about 4 to about 8 wt. % with the said acetic acid and water.

While U.S. Pat. No. 3,816,310 stresses that the temperature at which carbonation is effected should not exceed 122° F. (50° C.), in accordance with my present invention, the carbonation step can be carried out at temperatures in the range of about 100° to about 200° F.

Furthermore, whereas said U.S. Pat. No. 3,816,310 requires a restricted time/temperature distillation profile, following the carbonation step, to obtain proper crystalline calcite structure and viscosity, my invention has no such restricted "controlled" time/temperature profile but, rather, possesses much wider latitude, further emphasizing another of several different aspects of the process of said patent and the 1-step process of my present invention in that, in my 1-step process, no specific distillation time table is required.

In the area of the disclosure of said U.S. Pat. No. 3,816,310 as to feedstocks, said patent states that thixotropy is obtained so long as such sulfonic acids as "NAB" Bottoms Sulfonates are combined with at least 60% of branched chain alkylbenzenes. Here, again, my invention has distinctly greater flexibility in this respect, emphasizing that my process is a process which differs in numbers of respects from the 1-step process described in U.S. Pat. No. 3,816,310.

In the practice of the novel 1-step process of my present invention, the essential ingredients which are initially mixed to form a single composition, with or without supplementary ingredients which are not essential to my invention, are the following:

(1) A liquid carrier which may be a light or volatile hydrocarbon having a boiling point below 430° F., e.g. hexane, heptane or mineral spirits; or a nonvolatile oil, particularly a mineral oil; or mixtures of said volatile and nonvolatile liquid carriers;

(2) A sulfonic acid which may be of the same types which are disclosed herein and which are commonly used in the production of thixotropic overbased calcium sulfonate greases or thickened compositions;

(3) Calcium oxide and/or calcium hydroxide;

(4) Water-soluble carboxylic acids, desirably aliphatic, and particularly acetic acid;

(5) For optimum results, in conjunction with the carboxylic acid, an alcohol or an alkoxyalkanol which may be one or more of the various available substituted or unsubstituted alcohols containing from 1 to 8 carbon atoms. The preferred alcohol is methanol, and the preferred alkoxyalkanol is methylcellosolve.

(6) Water is generally produced during the reaction to provide the water for use in the 1-step process of my invention, but additional water is most desirable.

In those instances in which the overbased calcium sulfonate is not formed in situ by a reaction which includes the reaction of the volatile solvent solution of the sulfonic acid with the calcium oxide and/or calcium hydroxide, the calcium sulfonate may be preformed and incorporated as such into the other ingredients.

The mixture of ingredients, prepared under conditions of agitation, is desirably preliminarily heated to temperatures in the range of about 95° F. to about 200° F., at which temperatures or during such initial heating carbonation is effected by introducing carbon dioxide directly into the mixture for a period of time to essentially convert from 80% to 100% of the calcium oxide and/or hydroxide to calcium carbonate. In the finished product, the calcium carbonate is present as crystalline calcite extremely finely divided or colloidally dispersed in the carrier. Under certain conditions, and in certain cases only, in the carrying out of the 1-step process of my invention, and as noted above, the solid calcium carbonate which forms is not solely calcite but contains some vaterite. At elevated temperatures, as, for example, 190° F., vaterite tends to form. This does not appear adversely to affect the production of greases or thickened compositions or the utility thereof or of thickened compositions where the vaterite content is present in relatively low proportions. However, where the calcium carbonate is formed entirely or largely as vaterite, the desired properties of the greases or thickened compositions are adversely affected and such vaterite formation is desirably to be avoided.

The greases or thickened complexes produced in accordance with the 1-step process of my present invention should possess a metal ratio of at least 5, better still at least 6, and for many uses desirably possess a metal ratio of 10 or 12 or, indeed, as high as about 25 or even somewhat greater. This is controlled by, among other considerations, the amount ahd selection of particular promoters. These matters, without regard to the bases of my present invention, are per se, known to the art and no patentable novelty is predicated broadly on procedures for producing overbased calcium sulfonate greases or thickened compositions having metal ratios such as those referred to above.

While reference has been made to the oil-soluble sulfonic acids which are useful in the practice of my present novel 1-step process or the calcium salts thereof, which contain in their molecules an aliphatic radical having at least 12 carbon atoms, said sulfonic acids can be represented by the formula $$[(R)_xA-SO_3]_yM$$

wherein R is an aliphatic linear or branched chain aliphatic, generally, alkyl radical containing at least 12 carbon atoms; A is a cyclic, advantageously hydrocarbon, nucleus such as benzene, naphthalene, phenanthrene, and the like; x is 1 or 2; and M is calcium or hydrogen. When M is hydrogen, $y=1$; and when M is calcium, $y=2$. As noted above, the overbased calcium sulfonates can be preformed and dissolved in the liquid medium or carrier, or said calcium sulfonates may be formed in situ therein by incorporating into the mixture of ingredients the sulfonic acid, desirably in solution in a volatile organic solvent such as Varsol or mineral spirits or in an oil, particularly a mineral oil, and calcium oxide and/or calcium hydroxide, most desirably calcium hydroxide; and promoters are used in amount and character such as to produce calcium sulfonates overbased to the desired metal ratio. I prefer to utilize as the sulfonic acid a Varsol solution of a mixture of sulfonic acids of linear mono-alkylbenzenes, branched-chain alkylbenzenes, and dialkylbenzenes, said sulfonic acids having a molecular weight in the range of about 450 to about 550, but there is nothing critical in the use of such sulfonic acids. In general, the preferred sulfonic acids will fall within the range of those having a molecular weight in the range of about 300 to about 650 or 700. They are, in general, commercial articles of commerce and sold by a number of chemical companies under various trade designations. Many more sulfonic acids useful in the practice of my 1-step process are disclosed in numbers of the patents to which I have referred above, such as U.S. Pat. Nos. 3,342,079; 3,372,115; 3,492,231; 3,746,643; and 3,816,310, the disclosures of which sulfonic acids are made a part of this specification by incorporation by reference thereto.

As noted above, the carbonation temperature should generally fall within the range of about 95° to 200° F. After the carbonation step has been finished, which, as noted above, may be from about 80% to 100% of the theoretical, the carbonated otherwise finished grease or thickened composition may be heated at higher temperatures, for instance, at about 280° F. or somewhat higher to drive off volatiles to such extent as may be desired.

The following numbered EXAMPLES are exemplary of the production of illustrative greases or thickened compositions made in accordance with the improved 1-step process of my present invention. It will be understood that my invention is not limited to the specific conditions and details shown in said EXAMPLES since various changes will readily occur to those skilled in the art in light of the disclosures provided in the specification and the guiding principles taught hereinabove. All parts stated are in parts by weight and all temperatures are recited in °F.

EXAMPLE 1

| | |
|---|---|
| Laboratory Apparatus Set-Up | 1. 3-necked creased distilling flask 3000 ml<br>2. Stirrer, variable speed, explosion proof with 3" diameter propeller, 12" shaft.<br>3. Thermometer 0–300° C.<br>4. Friedricks Condenser.<br>5. Heating mantle.<br>6. General purpose $CO_2$ 2-stage flowmeter.<br>7. Gas sparger. |

| | Grams | |
|---|---|---|
| Ingredients Charged | 870 | 28% Active Varsol Solution of Sulfonic Acid |
| | 173 | Ca $(OH)_2$ |
| | 54 | Methanol |
| | 45 | Water |
| | 4.6 | Glacial Acetic Acid |
| | 350 cc/min @ | Carbon Dioxide (typical 2 hours for conversion). |

Procedure:

The Varsol solution of the Sulfonic Acid is added to the 3-necked distillation flask, the Friedricks condenser is hooked up, and mixing is initiated. The Ca $(OH)_2$ is added to the flask followed by the addition of the methanol and then the water. The flask is heated to 125° and the glacial acetic acid is added, and the ingredients are post-mixed for about 5 minutes. The gaseous $CO_2$ is then introduced through the glass sparger via the flowmeter. The carbonate peak is monitored at 882–886 via I.R. When all of the calcium carbonate is in this form (rather than 860), the reaction is complete. The introduction of $CO_2$ is discontinued.

EXAMPLE 2

In a suitable plant set-up, involving a reactor of adequate capacity and the otherwise general set-up of equipment modified for plant size operation, there is charged to the reactor 7135 pounds of a 28% solution in Varsol of the sulfonic acid, followed by the addition in order of 1402 pounds of Ca $(OH)_2$, 443 pounds of methylcellosolve, 369 pounds of water, the reaction mixture is heated to about 125° , and 36.9 pounds of glacial acetic acid are added, and then the resulting mixture is carbonated at a rate of about 6.3 pounds per minute until the carbonation results in a monitored carbonate peak at 882–886 via I.R.

| | | | |
|---|---|---|---|
| Typical Final Product | Non-volatile | 52.% | #6 spindle |
| | Viscosity | 80,000 | Brookfield at 10 RPM |
| | Viscosity at 40% N.V. | 20,000 | |

EXAMPLE 3

In a suitable plant set-up, there is charged to the reactor, under conditions of agitation, 4350 gallons of a 28% solution in Varsol of a sulfonic acid comprising a mixture of sulfonic acids of linear mono-alkyl benzenes, sulfonic acids of branched chain mono-alkyl benzenes and sulfonic acid linear dialkyl benzenes, said mixed sulfonic acids having a molecular weight of about 465; 6380 pounds of Mississippi hydrated lime, 215 gallons of methylcellosolve, 171 gallons of water, and 16.3 gallons of glacial acetic acid. The resulting mixture, heated to a temperature of 140° , is then carbonated with 2640 pounds of carbon dioxide pumped into the reaction mixture at a rate of 22.1 pounds per minute. The carbon dioxide temperature profile is 125° ∝ 137°.

EXAMPLE 4

A suitable reactor with heat exchange and agitator facilities is charged with 140 parts of a 28% solution in Varsol of an oil-soluble commercial sulfonic acid comprising a mixture of mono-alkyl and dialkyl sulfonic acids having a molecular weight of about 465. To this solution are added:

Hydrated Lime: 32 parts
Water: 8 parts
Methyl Cellosolve: 10 parts
Acetic Acid: 0.8 parts $CO_2$ is introduced into the agitated mixture over a period of 100 minutes until the calcium hydroxide is substantially neutralized.

The temperature is maintained at about 130° F. during the reaction. After the reaction is complete, water and methylcellosolve are removed by distillation. The reactor contents are filtered through a 200-mesh screen to remove any coarse residual solids. The purified composition is the desired thickened complex in mineral spirits.

EXAMPLE 5

A suitable reactor, as referred to above, is charged with 130 parts of a 32% solution of calcium sulfonate in a pale oil mineral oil.

To this solution are added:

Hydrated Lime: 60 parts
Naphtha: 150 parts
Methanol: 6 parts
Acetic Acid: 6 parts $CO_2$ is introduced in the agitated mixture over a period of 120 minutes until the calcium hydroxide is substantially neutralized. The temperature is maintained at about 185° F. during the reaction. After the reaction is complete, water, methanol and naphtha are removed by distillation. The reactor contents are filtered through a 200-mesh screen to remove any coarse residual solids. The purified composition is the desired thickened overbased calcium sulfonate complex in said mineral oil.

EXAMPLES 6–13

Effect of carbonation time investigations is shown in the following experiments. The procedure of EXAMPLE 1 is followed and rat of carbon dioxide is varied.

| Example | Carbonation Reaction (Minutes) | Time for Product |
|---|---|---|
| 6 | 30 | Not thickened |
| 7 | 40 | Not thickened |
| 8 | 50 | Not thickened |
| 9 | 60 | Thickened |
| 10 | 80 | Thickened |
| 11 | 100 | Thickened |
| 12 | 120 | Thickened |
| 13 | 160 | Thickened |

EXAMPLES 14–20

The effect of methylcellosolve on the product investigations. The procedure of EXAMPLE 1 is followed but the amount of methylcellosolve is varied.

| Example | Amount of Methylcellosolve (parts) | Product |
|---|---|---|
| 14 | 4 | Not thickened |
| 15 | 6 | Not thickened |
| 16 | 8 | Thickened |
| 17 | 10 | Thickened |
| 18 | 12 | Thickened |
| 19 | 15 | Thickened |
| 20 | 20 | Thickened |

EXAMPLES 21–26

Effect of temperature of carbonation procedure as for EXAMPLE 1 but temperature of reaction is varied.

| Example | Temperature of Reaction °F. | Product |
|---|---|---|
| 21 | 122 | Thickened |
| 22 | 140 | Thickened |
| 23 | 158 | Thickened |
| 24 | 176 | Thickened |
| 25 | 194 | Thickened |
| 26 | 212 | Thickened |

EXAMPLES 27–29

Effect of acetic acid on product. Procedure as for EXAMPLE 2 but acetic acid is varied.

| Example | Acetic Acid (Parts) | Product |
|---|---|---|
| 27 | 0 | Not thickened |
| 28 | 3 | Thickened |
| 29 | 9 | Thickened |

EXAMPLES 30–34

Effect of water on product. Procedure as for EXAMPLE 1 but water concentration is varied.

| Example | Water Added (Parts) | Product |
|---|---|---|
| 30 | 0 | Thickened |
| 31 | 3 | Thickened |
| 32 | 6 | Thickened |
| 33 | 15 | Thickened |
| 34 | 24 | Thickened |

EXAMPLES 35 and 36

Use of acids other than acetic acid.

To a 3-neck 1-liter flask fitted with condenser, thermometer, a gas dispersion tube and mixer, a solution of calcium sulfonate (254 g at 29.5% active ingredient in mineral spirits/mineral oil) is added. Mixing is initiated and 76.2 g calcium hydroxide is added, followed by 14.5 g of methanol and 11.6 g of water. The reaction mixture is heated to 120° . There is then added 2.6 g of carboxylic acid (see following Table I for specific acid), at this temperature and, while mixing, gaseous $CO_2$ is introduced through the gas dispersion tube at a rate of 220 ml per minute. The temperature is maintained at 120° to 140° during the reaction. The introduction of gaseous carbon dioxide is continued until substantially all of the calcium hydroxide is neutralized (about 85 minutes). The reaction mixture is then heated to about 260° to remove the water and methanol. The resulting composition is the desired thickened composition or grease consisting of calcium sulfonate/calcium carbonate complex in mineral spirits/mineral oil. The calcium carbonate is in the form of calcite as shown by the sharp infrared absorption peak at 882 via I.R.

TABLE I

TABLE OF EXPERIMENTAL RESULTS

| Example | Acid | *Viscosity at 50% Non-Volatile |
|---|---|---|
| 35 | Formic Acid | 7600 cps |
| 36 | Butyric Acid | 6700 cps |

*Brookfield cps @ 77° F., 10 rpm #6 spindle

The products of the improved 1-step process of my invention impart excellent rust protection when compounded as described in U.S. Pat. No. 3,746,643, as illustrated by EXAMPLE A.

EXAMPLE A

Product from EXAMPLE 1 (30 parts) is blended with wax (30 parts), Oxidized Petrolatum (10 parts) and Mineral Spirits (40 parts). Steel panels coated with this composition are tested in a salt fog cabinet in accordance with ASTM B117.

Performance:

0.5 mil dry coating after 300 hours, no rust is observed.

The foregoing EXAMPLES illustrate the flexibility of the process.

Various supplemental ingredients may, and commonly are, incorporated into the greases or thickened compositions made in accordance with the 1-step process of my invention, in very distinctly minor proportions, but they are in no way essential to my invention and no patentable novelty is claimed in their use in those instances where they are included in the preparation of greases or thickened compositions. Illustrative of such supplemental ingredients are oxidation inhibitors such as phenyl alpha naphthylamine (PAN); viscosity improvers, which may comprise certain polymers (Acryloid 155-C); and others for particular and generally known properties in greases or thickened compositions. They are preferably added after the preparation of the grease or thickened composition has been completed.

The complex overbased calcium sulfonate greases or thickened compositions made in accordance with my 1-step process can readily be admixed with oleaginous materials such as oils and fats, as well as with paraffin waxes, microcrystalline waxes, asphalts, oxidized petrolatums and other materials, in accordance with known practices, and other and variant practices, to produce compositions having utility as greases, rust-inhibiting coatings and for various other purposes.

I claim:

1. An improved 1-step process for preparing a thixotropic overbased calcium sulfonate complex in the form of a grease or thickened composition, which comprises forming a liquid mixture containing a liquid carrier material in the form of a volatile liquid hydrocarbon or a nonvolatile oil or a mixture thereof; a sulfonic acid having or including an aliphatic chain containing at least 12 carbon atoms and having a molecular weight in the range of about 300 to about 700; calcium oxide and/or calcium hydroxide; a member selected from the group of $C_1$–$C_4$ water-soluble aliphatic alcohols and water-soluble alkoxyalkanols; a water-soluble carboxylic acid; and water; agitating and heating said mixture to a temperature in the range of about 95° to about 200° F. and carbonating said mixture for a period of time to effect between about 80% and 100% of completion of carbonation until the reaction mixture is changed to a grease or a thickened composition containing colloidally dispersed particles of calcium carbonate in the form of calcite crystals.

2. The process of claim 1, in which the molecular weight of the sulfonic acid is in the range between 450 and 550.

3. The process of claim 1, in which the alcohol is methanol.

4. The process of claim 1, in which the water-soluble carboxylic acid is acetic acid.

5. An improved 1-step process for preparing thixotropic overbased calcium sulfonate complex greases or thickened compositions, the steps which comprise introducing into a reactor a volatile liquid hydrocarbon solution of a sulfonic acid or acids having or including an aliphatic chain of at least 12 carbon atoms, said sulfonic acid or acids having a molecular weight in the range of about 450 to about 550; calcium oxide and/or calcium hydroxide whereby to produce a calcium sulfonate dispersing agent; a member selected from the group of $C_1$–$C_4$ aliphatic water-soluble aliphatic alcohols and water-soluble alkoxyalkanols; a water-soluble carboxylic acid; and water; heating said mixture under conditions of agitation to a temperature in the range of about 95° to about 200° F.; and then carbonating said mixture at a temperature in the range of about 95° to about 200° F. until the reaction mixture is changed to a grease or a thickened composition containing colloidally dispersed particles of calcium carbonate in the form of calcite crystals.

6. The process of claim 5, in which the alcohol is methanol.

7. The process of claim 5, in which the water-soluble carboxylic acid is acetic acid.

8. An improved 1-step process for preparing a thixotropic overbased calcium sulfonate complex in the form of a grease or thickened composition, which comprises forming a liquid mixture containing a liquid carrier material in the form of a volatile liquid hydrocarbon or a nonvolatile oil or a mixture thereof; a sulfonic acid having or including an aliphatic chain containing at least 12 carbon atoms and having a molecular weight in the range of about 300 to about 700; calcium oxide and/or calcium hydroxide; a member selected from the group of $C_1$–$C_4$ water-soluble aliphatic alcohols and water-soluble alkoxyalkanols; a water-soluble carboxylic acid; and water; agitating and heating said mixture to a temperature in the range of about 95° to about 200° F. and carbonating said mixture for a period of time to effect between about 80% and 100% of completion of carbonation until the reaction mixture is changed to a grease or a thickened composition containing colloidally dispersed particles of calcium carbonate in the form of calcite crystals.

9. An improved 1-step process for preparing a thixotropic overbased calcium sulfonate complex in the form of a grease or thickened composition, which comprises forming a liquid mixture containing a liquid carrier material in the form of a volatile liquid hydrocarbon, a sulfonic acid having or including an aliphatic chain containing at least 12 carbon atoms and having a molecular weight in the range of about 450 to about 550; calcium hydroxide; methylcellosolve; acetic acid; and water; the methylcellosolve constituting from about 4 to about 6 wt. % and the acetic acid, calculated as glacial acetic acid, constituting from about 0.2 to about 2 wt. % of said mixture of ingredients; agitating and heating said mixture to a temperature in the range of about 95° to about 200° F. and carbonating said mixture for a period of time to effect between about 80% and 100% of completion of carbonation until the reaction mixture is changed to a grease or a thickened composition containing colloidally dispersed particles of calcium carbonate which is produced in the form of calcite crystals.

10. An improved 1-step process for preparing thixotropic overbased calcium sulfonate complex greases or thickened compositions, the steps which comprise introducing into a reactor a volatile liquid hydrocarbon solution of a calcium sulfonate dispersing agent, calcium oxide and/or calcium hydroxide; a member selected from the group of $C_1$–$C_4$ water-soluble aliphatic alcohols and water-soluble alkoxyalkanols; a water-soluble carboxylic acid; and water; heating said mixture under conditions of agitation to a temperature in the range of about 95° to about 200° F.; and then carbonating said mixture at a temperature in the range of about 95° to about 200° F. until the reaction mixture is changed to a grease or thickened composition containing colloidally dispersed particles of calcium carbonate in the form of calcite crystals.

11. The process of claim 10, in which the alcohol is methanol.

12. The process of claim 10, in which the acid is acetic acid.

13. The process of claim 10, in which the acid is butyric acid.

14. The process of claim 10, in which the acid is formic acid.

* * * * *